US010576012B2

(12) United States Patent
Ishikawa et al.

(10) Patent No.: US 10,576,012 B2
(45) Date of Patent: Mar. 3, 2020

(54) MASSAGING APPARATUS

(71) Applicant: DAITO ELECTRIC MACHINE INDUSTRY COMPANY LIMITED, Higashi-Osaka-shi, Osaka (JP)

(72) Inventors: Tetsuya Ishikawa, Higashi-Osaka (JP); Shinsaku Shimizu, Higashi-Osaka (JP)

(73) Assignee: DAITO ELECTRIC MACHINE INDUSTRY COMPANY LIMITED, Higashi-Osaka-Shi (JP)

( * ) Notice: Subject to any disclaimer, the term of this patent is extended or adjusted under 35 U.S.C. 154(b) by 397 days.

(21) Appl. No.: 15/510,874

(22) PCT Filed: Sep. 8, 2015

(86) PCT No.: PCT/JP2015/075445
§ 371 (c)(1),
(2) Date: Mar. 13, 2017

(87) PCT Pub. No.: WO2016/063648
PCT Pub. Date: Apr. 28, 2016

(65) Prior Publication Data

US 2017/0273857 A1 Sep. 28, 2017

(30) Foreign Application Priority Data

Oct. 20, 2014 (JP) ..... 2014-213696

(51) Int. Cl.
*A61H 7/00* (2006.01)
*A61H 9/00* (2006.01)
*A61H 23/02* (2006.01)

(52) U.S. Cl.
CPC ..... *A61H 7/007* (2013.01); *A61H 7/00* (2013.01); *A61H 7/004* (2013.01); *A61H 9/0092* (2013.01);
(Continued)

(58) Field of Classification Search
CPC ..... A61H 7/00; A61H 7/007; A61H 7/004; A61H 9/00; A61H 9/0078; A61H 9/0092;
(Continued)

(56) References Cited

U.S. PATENT DOCUMENTS

2002/0161316 A1* 10/2002 Shimizu ..... A61H 7/00 601/98
2007/0021694 A1 1/2007 Shiraishi
(Continued)

FOREIGN PATENT DOCUMENTS

CN 2661163 Y 12/2004
CN 202314199 U 7/2012
(Continued)

*Primary Examiner* — Timothy A Stanis
*Assistant Examiner* — Matthew Standard
(74) *Attorney, Agent, or Firm* — Birch, Stewart, Kolasch & Birch, LLP

(57) ABSTRACT

A massaging apparatus has two massaging systems arranged proximate to each other for performing more elaborate massage on target body areas. The massaging apparatus includes a first massaging member pair for massaging target areas; a second massaging member pair, provided independently of the first massaging member pair, for massaging target areas; a rotation shaft rotatably driven; a paired first conversion mechanisms, each disposed on a corresponding one of the first massaging members, for converting rotation of the rotation shaft into mutually approaching and separating movements of the first massaging members; and a second conversion mechanism for converting rotation of the rotation shaft into mutually approaching and separating movements of the paired second massaging members. The second massaging member pair is disposed between the paired first massaging members, and the second conversion mechanism is disposed between the paired first conversion mechanisms.

7 Claims, 8 Drawing Sheets

(52) U.S. Cl.
CPC . *A61H 23/0263* (2013.01); *A61H 2201/0149* (2013.01); *A61H 2201/1215* (2013.01); *A61H 2201/1669* (2013.01); *A61H 2201/5066* (2013.01); *A61H 2205/10* (2013.01); *A61H 2205/106* (2013.01); *A61H 2205/12* (2013.01)

(58) Field of Classification Search
CPC ..... A61H 15/00; A61H 2201/164; A61H 2201/1642; A61H 2201/1657; A61H 2201/1671; A61H 2201/1669; A61H 2205/10; A61H 2205/106; A61H 2205/12; A61H 2201/00; A61H 2201/0138; A61H 2201/0149
See application file for complete search history.

(56) References Cited

U.S. PATENT DOCUMENTS

| | | | | |
|---|---|---|---|---|
| 2010/0137758 | A1* | 6/2010 | Nagamitsu ..... | A61H 7/004 601/97 |
| 2012/0316478 | A1* | 12/2012 | Inada ..... | A61H 7/007 601/126 |

FOREIGN PATENT DOCUMENTS

| | | | |
|---|---|---|---|
| CN | 203244566 | U | 10/2013 |
| CN | 203724427 | U | 7/2014 |
| CN | 203724438 | U | 7/2014 |
| JP | 2003-665 | A | 1/2003 |
| JP | 2012-10854 | A | 1/2012 |
| JP | 2012-254209 | A | 12/2012 |
| JP | 2013-9733 | A | 1/2013 |
| WO | WO 2005/023169 | A1 | 3/2005 |

* cited by examiner

MASSAGING APPARATUS

TECHNICAL FIELD

The present invention relates to a massaging apparatus.

BACKGROUND ART

There is a heretofore known chair massager having a plurality of massaging members that produce different massage actions, including a massaging member for kneading massage and a massaging member for tapping massage.

In a massager of this type, in general, kneading massage operation is effected by exploiting a rotational driving force of a rotation shaft which is rotated by, for example, a drive motor for kneading action, and, on the other hand, tapping massage operation is effected by exploiting a rotational driving force of a rotation shaft for tapping operation which is rotated by a drive motor for tapping action. That is, in the massager having the massaging members for producing different massage actions, a rotation shaft is assigned to each individual massaging member, and, these rotation shafts are driven independently by their respective driving sections such as motors. This makes it possible to provide various types of massage treatment.

As an example of such a massager, Patent Literature 1 discloses a massaging apparatus comprising a leg-rest massaging mechanism for massaging each calf of user's leg, and a foot-rest massaging mechanism for massaging the feet of user's right and left legs.

PRIOR ART REFERENCE

Citation List

Patent Literature 1: WO 05/023169

SUMMARY OF INVENTION

Technical Problem

In present day massager requirements, there may be a desire to perform elaborate massage on a target area of user's body by simultaneously actuating a plurality of massaging mechanisms arranged proximate to each other that provide various types of massage treatment. For example, there is a growing demand for "more elaborate massage than ever" which involves kneading massage and pressing massage that are performed on one target body area at one time by actuating two massaging mechanisms simultaneously.

It is however difficult to satisfy such a demand for "more elaborate massage" with use of the described massaging apparatus disclosed in Patent Literature 1 in which individual driving mechanisms cannot be arranged proximate to each other in fear of occurrence of interference between the massaging mechanisms.

The present invention has been devised in view of the circumstances as discussed supra, and accordingly an object of the invention is to provide a massaging apparatus which is capable of performing more elaborate massage than ever on a target body area by a plurality of massaging systems for achieving various types of massage treatment that are arranged adjacent each other.

Solution to Problem

To solve the described problem, the following technical means is adopted for the implementation of the present invention.

That is, a massaging apparatus pursuant to the present invention comprises: a pair of first massaging members for massaging a target body area; a pair of second massaging members, provided independently of the first massaging members, for massaging a target body area; a rotation shaft which is rotatably driven; a pair of first conversion mechanisms, each disposed on corresponding one of the paired first massaging members, for converting a rotation of the rotation shaft into mutually approaching and separating movements of the paired first massaging members; and a second conversion mechanism for converting the rotation of the rotation shaft into mutually approaching and separating movements of the paired second massaging members. In this construction, the second massaging member pair is disposed between the paired first massaging members, and the second conversion mechanism is disposed between the paired first conversion mechanisms.

In the invention, it is preferable that a direction of mutually approaching and separating movements of the paired first massaging members and a direction of mutually approaching and separating movements of the paired second massaging members are in intersecting relation to each other.

In the invention, it is preferable that the first conversion mechanism comprises: a first boss portion, mounted for unitary rotation with the rotation shaft, having formed on its outer peripheral surface an inclined cam face inclined with respect to an axis of the rotation shaft; and a first fit portion disposed at a basal end of the first massaging member so as to rotatably engage the inclined cam face of the first boss portion, and that the first massaging member is restrained against rotation together with the rotation shaft.

In the invention, it is preferable that the second conversion mechanism comprises: a second boss portion which has formed on its outer peripheral surface an eccentric cam face which moves around an axis in eccentric relation to the axis of the rotation shaft; and a second fit portion disposed at a basal end of the second massaging member so as to rotatably engage the eccentric cam face of the second boss portion, and that the second massaging member is restrained against rotation together with the rotation shaft.

In the invention, it is preferable that, along the axis of the rotation shaft, there are arranged the first boss portion of one of the first conversion mechanisms, the second boss portion of the second conversion mechanism located adjacent to the first boss portion of the one first conversion mechanism, and the first boss portion of the other one of the first conversion mechanisms located adjacent to the second boss portion of the second conversion mechanism yet opposite from the one first conversion mechanism.

In the invention, it is preferable that a tip of the second massaging member pair is branched into a plurality of branch bodies, that a cover body is provided for covering the tip of the second massaging member, and that the cover body is formed with a plurality of insertion holes, through each of which is passed corresponding one of a plurality of the branch bodies of the second massaging member.

In the invention, it is preferable that there is further provided vertically moving means for allowing the first massaging member and the second massaging member to move in a vertical direction.

In the invention, it is preferable that the vertically moving means imparts vertical movement to the first massaging member and the second massaging member by exploiting a rotational driving force of another rotation shaft disposed substantially in parallel with the rotation shaft.

Advantageous Effects of Invention

The massaging apparatus pursuant to the present invention is capable of performing more elaborate massage than ever on a target body area by a plurality of adjacent massaging systems for achieving various types of massage treatment.

EMBODIMENTS

Figure 1:
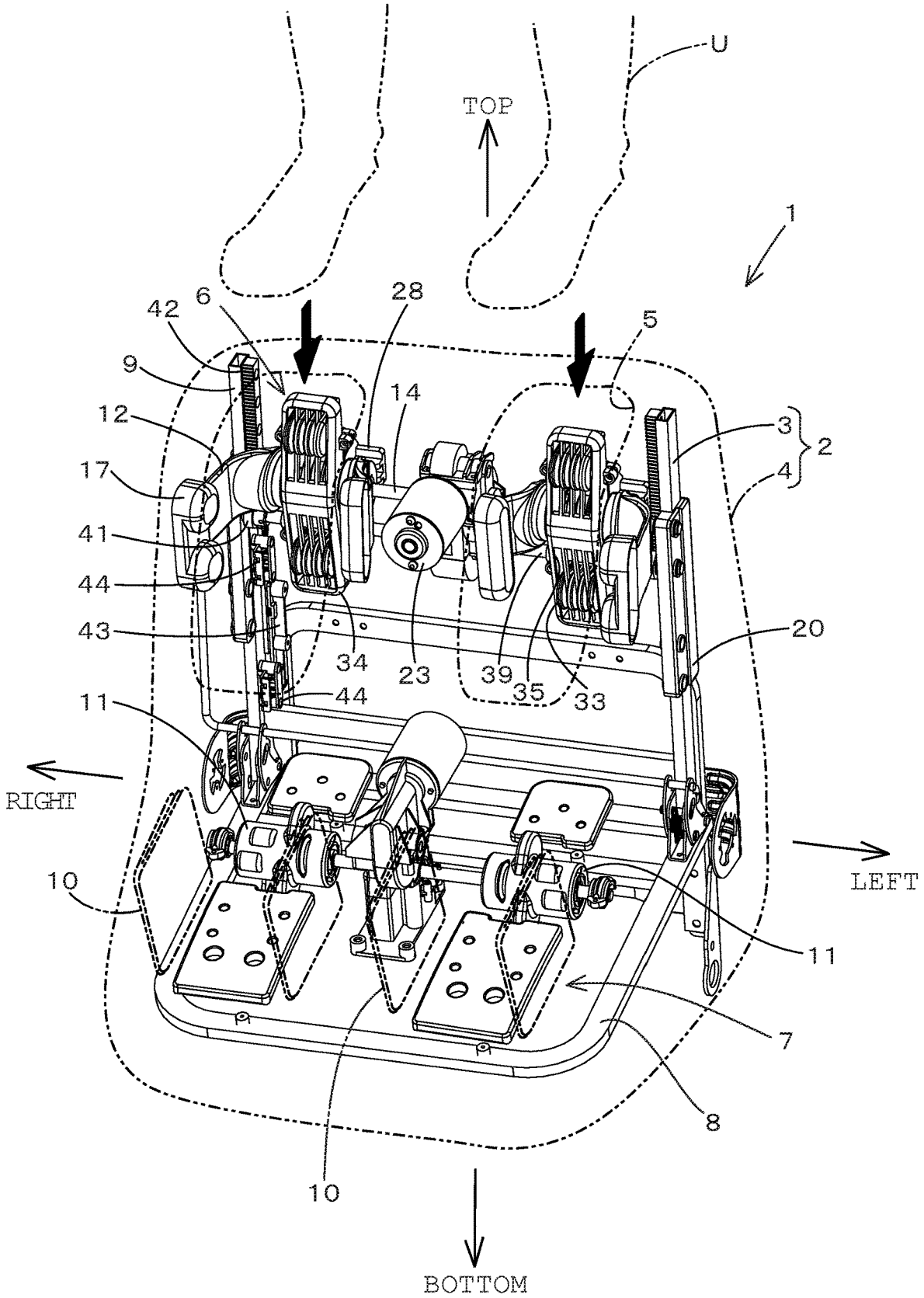
FIG. 1 is a perspective view showing a massaging apparatus in accordance with a present embodiment as a whole.

Hereinafter, an embodiment of the present invention will be described with reference to drawings.

In FIGS. 1 to 8, there is shown an embodiment of a massaging apparatus 1 pursuant to the present invention.

The massaging apparatus 1 of this embodiment comprises a massaging main body 2 which is rectangular-shaped when viewed from in front, and is substantially triangular-shaped (substantially boot-shaped) when viewed from a side. The massaging main body 2 comprises a support frame 3 constructed of combined rodlike members in the form of substantially the letter of "L" as seen in side view, and a massaging system attached to the support frame 3. The support frame 3 and the massaging system are covered with a casing 4.

The upper part of the massaging main body 2 is formed with two horizontally spaced apart insertion recesses 5, each opening into the front and the top of the upper part, for receiving the legs of a user U. Moreover, as described above, the massaging main body 2 is internally provided with a lining material which has elasticity, flexibility, and adequate air permeability, and the massaging system for massaging the legs of the user U. The massaging system is used to massage the leg of the user U inserted into the massaging main body 2 through the insertion recess 5.

The described massaging system comprises an upper massaging system 6 for massaging the upper part of user's leg such as the calf, and a lower massaging system 7 for massaging the lower part of the leg such as the foot. Of these two massaging systems, the lower massaging system 7 is attached to a stand frame member 8 directed in a front-rear direction, which is one of frame members constituting the support frame 3. A heretofore known massaging system is adopted to implement the lower massaging system 7. On the other hand, the upper massaging system 6 is attached to a back frame member 9 directed in a vertical direction, which is one of the frame members constituting the support frame 3. A massaging system embodying a feature of the massaging apparatus 1 pursuant to the present invention is adopted to implement the upper massaging system 6.

Prior to the description of the upper massaging system 6 embodying a feature of the massaging apparatus 1 pursuant to the present invention, the lower massaging system 7 will be briefly described first.

In the following description of the massaging apparatus 1, as shown in FIG. 1, the direction of height of the massaging apparatus 1 set in place on, for example, a floor will be defined as a vertical direction, and, other directions, namely a horizontal direction and a front-rear direction, are determined on the basis of the vertical direction. The vertical direction, the horizontal direction, and the front-rear direction as above described coincide with a vertical direction, a horizontal direction, and a front-rear direction, respectively, based on the view of the user U with his/her legs inserted in the massaging apparatus 1. For the sake of clarity on the relationship between the directions viewing the drawing and the actual directions of the apparatus, some representative drawings detail the vertical direction (height direction), the horizontal direction (width direction), and the front-rear direction used in the description of the present embodiment.

As shown in FIG. 1, the lower massaging system 7 is designed to massage the foot of the user U, and thus comprises two massaging members, namely an air massage member 10 and a sole-massaging member 11.

The air massage member 10 is an air-bag massaging member configured to contain air for free inflation and deflation, into which is fed compressed air from a non-illustrated air compressor. The air massage member 10 is capable of performing pressing massage on each foot of the user U by squeezing the foot from both sides in the horizontal direction.

Moreover, the sole-massaging member 11 is designed to perform finger-pressure massage (sole massage) on the sole of the user U by pressing, against pressure points of user's sole, a projection formed on the outer peripheral surface of a rotating body which rotates about a horizontally-directed axis.

Figure 2:
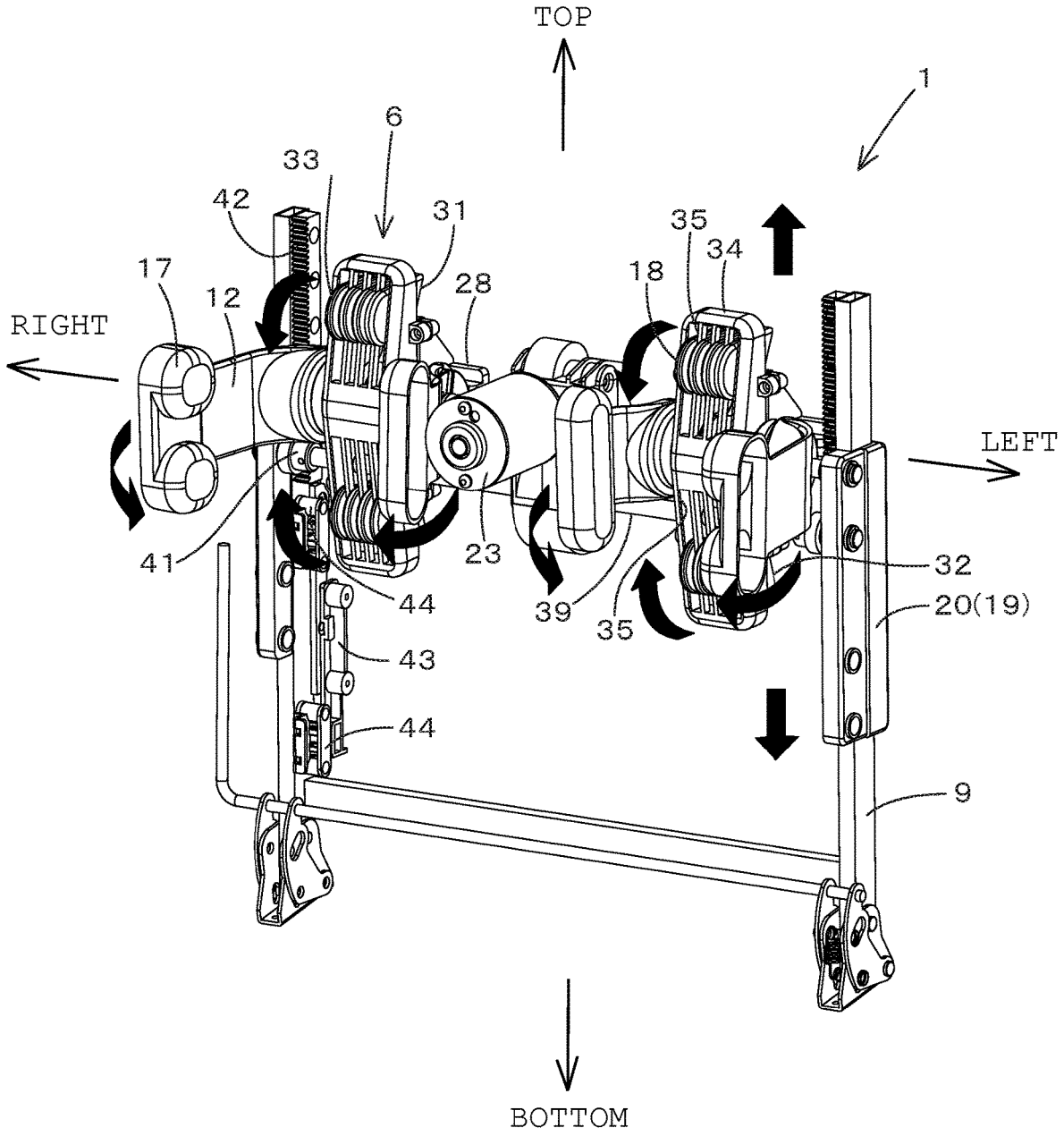
FIG. 2 is a perspective view showing an upper massaging system provided in the massaging apparatus of the present embodiment.

Meanwhile, as shown in FIG. 2, the upper massaging system 6 comprises: a pair of first massaging members 12 for massaging the calf of the user U (target area of user's body); a pair of second massaging members 13, provided independently of the first massaging members 12, for massaging the target body area; a rotation shaft 14 which is rotatably driven; a pair of first conversion mechanisms 15, each disposed on corresponding one of the paired first massaging members 12, for converting the rotation of the rotation shaft 14 into mutually approaching and separating movements of the paired first massaging members 12; and a second conversion mechanism 16 for converting the rotation of the rotation shaft 14 into mutually approaching and separating movements of the paired second massaging members 13.

More specifically, in this embodiment, the paired first massaging members 12 are designed to massage a target body area held centrally between them by a left-side first massager piece 17*b* and a right-side first massager piece 17*a* that move close to and away from each other in the horizontal direction. Moreover, the paired second massaging members 13 are designed to massage a target body area by an upper-side second massager piece 18 and a lower-side second massager piece 18 that move close to and away from each other in the vertical direction.

In the massaging apparatus 1 pursuant to the present invention, to actuate the described first and second massaging members 12 and 13 simultaneously within a narrow operating range, the second massaging member 13 pair is located between the paired first massaging members 12, and, the second conversion mechanism 16 is located between the paired first conversion mechanisms 15.

The following describes the rotation shaft 14, the first massaging member 12, the second massaging member 13, the first conversion mechanism 15, and the second conversion mechanism 16 that constitute the upper massaging system 6 of the massaging apparatus 1 pursuant to the present invention.

As shown in FIGS. 3 to 6, the rotation shaft 14 is a shaft member disposed with its axis directed in the horizontal direction. The rotation shaft 14 is supported at both ends, namely left and right ends, by bearing portions each provided in an up-and-down body of vertically moving means 19 which will hereafter be described. The bearing portion allows the rotation shaft 14 to rotate about a horizontally-directed axis.

A first gear 21 and a second gear 22 are located centrally of the rotation shaft 14 in the direction of its length. The first gear 21 is a pinion gear 41 disposed on a drive shaft of a drive motor 23. The first gear 21 in meshing engagement with the second gear 22 disposed on the rotation shaft 14 transmits a rotational driving force of the drive shaft, while effecting deceleration, to the second gear 22.

There are provided two sets, namely a left-side set and a right-side set, of the described paired first massaging members 12 and paired second massaging members 13, and, each set is located between the second gear 22-bearing part (center) of the rotation shaft 14 and corresponding one of the bearing portions (located at the left end and the right end, respectively, of the rotation shaft 14). More specifically, on the rotation shaft 14, the paired second massaging members 13 are arranged adjacent each other in the vertical direction, and, the paired first massaging members 12 are arranged so as to have sandwiched therebetween the paired second massaging members 13 in the horizontal direction. Thus, there are provided two sets of the massaging systems, each comprising the paired first massaging members 12 and the paired second massaging members 13, located on the right side and the left side, respectively, of the rotation shaft 14 in corresponding relation to the right calf and the left calf, respectively, of the user U.

The right-hand first massaging member 12 pair and the left-hand first massaging member 12 pair have substantially the same structure, wherefore the following description deals only with the right-hand first massaging member 12 pair by way of example.

The first massaging members 12, each in the form of a long strip-like plate extending in the front-rear direction, are rocked in the horizontal direction under a rotational driving force of the rotation shaft 14, so that the calf (target body area) of the user U can be massaged by the first massager pieces 17, each disposed at the tip of the corresponding first massaging member 12, in a state of holding the calf in between in the horizontal direction. More specifically, the first massaging member 12 is shaped so as to extend horizontally outwardly from its basal end attached to the rotation shaft 14.

The tip (forward end) of the first massaging member 12 is provided with the first massager piece 17 which is brought into contact with the target body area of the user U for massage treatment. Moreover, the basal end of the first massaging member 12 (the basal end of each of the paired right-hand and left-hand first massaging members 12) is provided with the first conversion mechanism 15 for imparting horizontal rocking motion to the first massaging member 12 through the conversion and transmission of the rotation of the rotation shaft 14.

The left-hand first massaging member 12 and the right-hand first massaging member 12 are each provided with a single first conversion mechanism 15.

More specifically, the first conversion mechanism 15 comprises: a first boss portion 24, mounted for unitary rotation with the rotation shaft 14, having formed on its outer peripheral surface an inclined cam face inclined with respect to the axis of the rotation shaft 14; and a first fit portion 25 which rotatably engages the inclined cam face of the first boss portion 24.

The first boss portion 24 is a member shaped in a circular plate mounted for rotations together with the described rotation shaft 14, and is thus rotatable about a horizontally-directed axis. The outer peripheral surface of the first boss portion 24 is formed with the inclined cam face which moves around an axis extending in a direction intersected by the axis of the rotation shaft 14. That is, the inclined cam face is designed to orbit in a horizontally meandering path over the outer peripheral surface of the first boss portion 24.

The inclined cam face of the left-hand first boss portion 24 and the inclined cam face of the right-hand first boss portion 24 meander in opposite directions, that is; the paths of the inclined cam faces of, respectively, the left-hand first boss portion 24 and the right-hand first boss portion 24 are in bilaterally symmetric relation to each other.

Moreover, the central part of the left-hand first boss portion 24 extends rightward in protrusion form so as to wrap the rotation shaft 14, and, the central part of the right-hand first boss portion 24 extends leftward in protrusion form so as to wrap the rotation shaft 14. As will hereafter be described, a second boss portion 26 is fitted onto the protrusion part of the first boss portion 24.

The first fit portion 25 is a cylindrical member fitted exteriorly of the inclined cam face of the first boss portion 24. An annular bearing is used for the first fit portion 25. The first fit portion 25 is attached to the basal end of the first massaging member 12 to permit rotations of the first massaging member 12 along the inclined cam face relative to the first boss portion.

The basal end of the described first massaging member 12 is formed with a restraint projection 27 protruding backward from the basal end of the first massaging member 12. The tip of the restraint projection 27 is inserted into a restraint slot 29 formed in a base member 28 which will hereafter be described. The restraint slot 29 of the base member 28 is formed so as to extend along the horizontal direction, and thus allows the restraint projection 27 inserted in the restraint slot 29 to move in the horizontal direction only, while restraining its vertical movement.

Thus, upon rotating the described rotation shaft 14, the first boss portion 24 secured to the rotation shaft 14 is rotated about the axis of the rotation shaft 14, with its inclined cam face moving around the rotation shaft 14 while meandering in the horizontal direction.

At this time, the first fit portion 25 disposed at the basal end of the first massaging member 12, being matingly fitted to the described inclined cam face, seeks to rotate along the inclined cam face in response to the rotation of the rotation shaft 14. However, as described above, since the restraint projection 27 formed at the basal end of the first massaging member 12 is inserted in the restraint slot 29 of the base member 28, it never occurs that the first massaging member 12 rotates together with the rotation shaft 14.

In addition, the horizontally-extending restraint slot 29 of the base member 28 will not obstruct the horizontal movement of the restraint projection 27. Therefore, as the first fit portion 25 moves along the inclined cam face meandering in the horizontal direction, the first massaging member 12 is rocked repeatedly in the horizontal direction only.

The meandering direction of the inclined cam face of the left-hand first boss portion 24 and the meandering direction of the inclined cam face of the right-hand first boss portion 24 are in bilaterally symmetric relation to each other. That is, when the left-hand first massaging member 12 is rocked rightward, the right-hand first massaging member 12 is rocked leftward. On the other hand, when the left-hand first massaging member 12 is rocked leftward, the right-hand first massaging member 12 is rocked rightward. Thus, the paired first massaging members 12 are moved close to and away from each other in the horizontal direction for massaging user's calf held between their first massager pieces 17.

The following describes the second massaging member 13 and the second conversion mechanism 16 for driving the second massaging member 13.

The second massaging member 13 is a member for massaging a target body area by co-operative operation of the second massager pieces 18 disposed at its forward end, namely the second massager piece 18 which faces the upper part of the target calf (the back side of the calf, in particular) and the second massager piece 18 which faces the lower part of the calf, under the transmitted rotational driving force of the rotation shaft 14. Like the first massaging member 12, the second massaging member 13 is constructed of a long strip-like plate extending in the vertical direction.

The basal end of the second massaging member 13 is provided with a second fit portion 30 of the second conversion mechanism 16, and, the forward end of the second massaging member 13 is provided with the described second massager pieces 18. Moreover, the basal end of the second massaging member 13 takes the form of adjacent members arranged side by side on the rotation shaft 14. One of the juxtaposed members is defined as an upper member 31, and the other is defined as a lower member 32.

More specifically, the upper member 31 extends upward from the basal end attached to the rotation shaft 14, and the lower member 32 extends downward from the basal end. The second massager piece 18 is disposed at the tip of each member. Upon rotating the rotation shaft 14, the upper member 31 and the lower member 32 are rocked up and down for performing grabbing massage and pressing massage on the target body area located between the upper and lower second massager pieces 18.

The second massager piece 18 is a rectangular member having an arcuately curved tip (forward end), and this curved tip presses and grabs the back side of user's calf. Moreover, in the second massager piece 18 of this embodiment, the tip branches off from the basal end (rear end) in comb-teeth form in the horizontal direction, and, each branched tip is formed with a branch body 33. Thus, the target body area can be massaged by a plurality of branch bodies 33.

A cover body 34 is a member which restrains the calf against backward movement, or equivalently prevents the calf from getting caught in, for example, a rocking mechanism (the second conversion mechanism 16) of the second massaging member 13, while permitting travel of the tip of the second massaging member 13 in the front-rear direction. The cover body 34 is formed with a plurality of insertion holes 35, through each of which is passed corresponding one of a plurality of the branch bodies 33 of the second massaging member 13 as above described. More specifically, a plurality of the insertion holes 35 are each shaped in a slit extending in the vertical direction, and thus the cover body 34 has a grid-like appearance. By virtue of the vertically-extending slit-like insertion holes 35 formed in the cover body 34, the described branch bodies 33 of the second massaging member 13 are each allowed to move forward and backward in the front-rear direction, and yet, for example, an accidental catching of the target body area can be prevented effectively.

Like the first conversion mechanism 15, the second conversion mechanism 16 acts to convert the rotation of the rotation shaft 14 into mutually approaching and separating movements of the paired second massaging members 13. Each second massaging member 13 pair, that is; the second massaging member 13 pair constituting the left-hand massaging system and the second massaging member 13 pair constituting the right-hand massaging system are each provided with a single second conversion mechanism 16.

More specifically, the second conversion mechanism 16 comprises: a second boss portion 26 which has formed on its outer peripheral surface an eccentric cam face which moves around an axis in eccentric relation to the axis of the rotation shaft 14; and a second fit portion 30 disposed at the basal end of the second massaging member 13 so as to rotatably engage the inclined cam face of the second boss portion 26.

The second boss portion 26 is, like the first boss portion 24, a member shaped in a circular plate mounted for rotations together with the described rotation shaft 14. The second boss portion 26 is disposed adjacent to the first boss portion 24 in the horizontal direction, as well as to be sandwiched between the first boss portions 24. The earlier described protrusion part of the first boss portion 24 is matingly fitted to the central part of the second boss portion 26 located near the rotation shaft 14. Thus, the second boss portion 26 is coupled to the first boss portion 24 via the protrusion part.

The second boss portion 26 is, like the first boss portion 24, mounted for unitary rotation with the rotation shaft 14. The form of the second boss portion 26 may be defined by two cylindrical bodies, each having a horizontally-directed axis, combined together with their axes displaced with respect to each other in the horizontal direction. Each of the two cylindrical bodies has its axis positioned in eccentric relation to the axis of the rotation shaft 14, and, the axes of the two cylindrical bodies are located so as to have sandwiched therebetween the axis of the rotation shaft 14.

The outer peripheral surface of the two cylindrical bodies constituting the second boss portion 26 is formed with an eccentric cam face which moves around an axis in eccentric relation to the axis of the rotation shaft 14. The second fit portion 30 rotatably engages the eccentric cam face.

The second fit portion 30 is, like the first fit portion 25, attached to the basal end of the second massaging member 13 to permit rotations of the second massaging member 13 along the eccentric cam face.

As the rotation shaft 14 is rotated, the basal end of the second massaging member 13 seeks to rotationally move in a path which is eccentric with respect to the axis of the rotation shaft 14. In reality, however, their unitary rotation is restrained by the action of restraint holes 36*a* and 36*b* and a restraint pin 37 as will hereafter be described.

That is, the described second massaging member 13 has formed at its basal end a projection 38 protruding in the opposite direction to the forward end bearing the second massager piece 18. The projection 38 of the second massaging member 13 has the restraint hole 36*a*, 36*b* in slot form formed so as to pass therethrough in the horizontal direction. The restraint hole 36*a*, 36*b* is formed so as to extend linearly in a radial direction with respect to the axis of the rotation shaft 14, for receiving the horizontally-extending restraint pin 37 mounted to the massaging main body 2.

More specifically, the restraint hole 36*a* of the upper member 31 of the second massaging member 13 is formed in the projection 38 located behind and below the rear of the described second boss portion 26 so as to extend at an upward incline from the lower rear part of the projection 38 to the upper front part thereof. Thus, even if the second massaging member 13 moves in an eccentric path along the eccentric cam face formed at the outer peripheral surface of the second boss portion 26, since the restraint hole 36*a* and the restraint pin 37 acting to support the basal end of the second massaging member 13 remains in a position behind and below the second boss portion 26 at all times, it follows that the obliquely upwardly facing upper member 31 of the second massaging member 13 is rocked in the vertical direction and in the front-rear direction repeatedly while remaining in substantially the same position.

Moreover, the lower member 32 of the second massaging member 13 is substantially structurally identical with the described upper member 13, wherefore, like the upper member 31, the obliquely downwardly facing lower member 32 is rocked in the vertical direction and in the front-rear direction repeatedly while remaining in substantially the same position.

Figure 3:
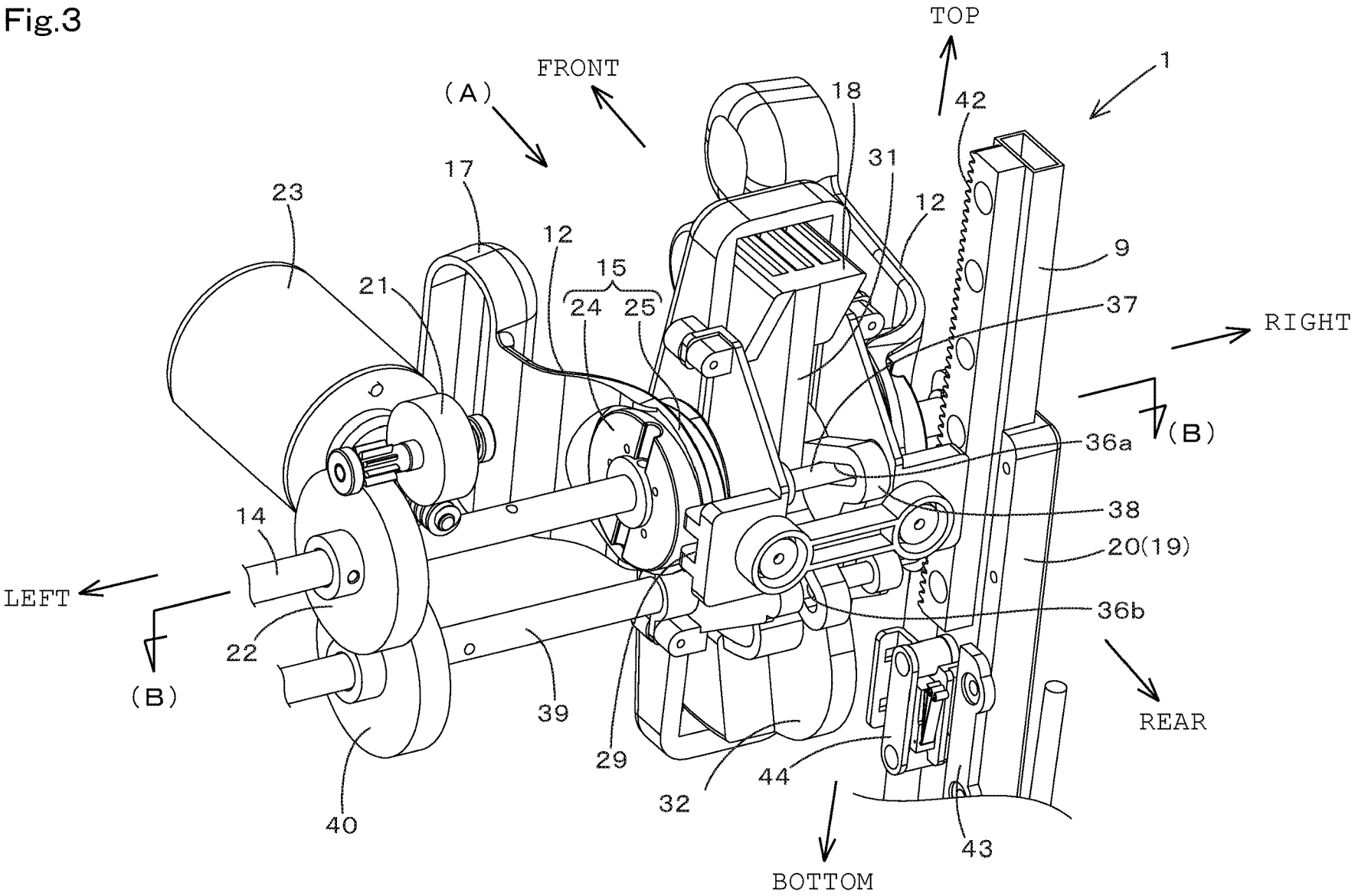
FIG. 3 is a rear perspective view showing the upper massaging system of the present embodiment in enlarged dimension.

As illustrated in detail in the drawings such as FIG. 3, at the rear side of the first massaging member 12 and the second massaging member 13, the base member 28 is disposed in straddling relation to each of the first rotation shaft 14 and a second rotation shaft 39.

The base member 28 is a platy member bent in the shape of substantially the letter of "L" as seen from above, the form of which may thus be defined by a combination of a portion extending in the front-rear direction and a portion extending in the horizontal direction. More specifically, there are provided the base members 28 located toward the right side and the left side, respectively, of the second massaging member 13 so as to have sandwiched therebetween the second massaging member 13. The cover body 34 is coupled to the front side, viz., the forward end of the portion extending in the front-rear direction, of each base member 28, and, the base members 28 located toward the right side and the left side, respectively, of the second massaging member 13 are coupled together in one piece via the centrally-located cover body 34.

Meanwhile, the rear side, viz., the horizontally-extending portion, of the base member 28 is formed with the described horizontally-extending restraint slot 29. Moreover, in between the left-hand base member 28 and the right-hand base member 28, the described restraint pin 37 is mounted so as to span the space between these base members 28. There is one restraint pin 37 on each of the upper and lower sides of the base member 28, or a total of two restraint pins 37 in all. The upper restraint pin 37 is inserted into the restraint hole 36*a* of the lower member 32 of the second massaging member 13, and the lower restraint pin 37 is inserted into the restraint hole 36*b* of the upper member 31 of the second massaging member 13.

Moreover, in between the base member 28 and the cover body 34, a first shaft hole is formed for insertion of the described first rotation shaft 14 in the horizontal direction. The first rotation shaft 14 is inserted into the first shaft hole. Moreover, in a position below the first shaft hole, a second shaft hole is formed for insertion of the second rotation shaft 39 in the horizontal direction. By the insertion of the first rotation shaft 14 into the first shaft hole and the insertion of the second rotation shaft 39 into the second shaft hole, the first gear 21, the second gear 22, the drive motor 23, the first massaging member 12, the first conversion mechanism 15, the second massaging member 13, and the second conversion mechanism 16 that are attached to the first rotation shaft 14, and the vertically moving means 19, which will hereafter be described, attached to the second rotation shaft 39 are coupled together for unitary vertical movement. That is, the described first and second massaging members 12 and 13, including their driving mechanisms, can be entirely moved up and down by the vertically moving means 19.

The following describes the operation of the massaging apparatus 1 pursuant to the present invention, in other words, a massaging method pursuant to the present invention.

That is, as the described rotation shaft 14 is rotated, the second boss portion 26 coupled to the first boss portion 24 through the engagement of the protrusion part is rotated about the axis of the rotation shaft 14. Then, the eccentric cam face formed at the outer peripheral surface of the second boss portion 26 moves in an eccentric path around the axis of the rotation shaft 14, and, the second fit portion 30 fitted onto the eccentric cam face and the second massaging member 13 in engagement with the second fit portion 30 seek to rotate about the axis of the rotation shaft 14 correspondingly.

However, with the restraint pin 37 inserted in a restraint hole 45 formed in the projection 38 of the basal end of the second massaging member 13, the second massaging member 13, while being allowed to rock in the vertical direction within a predetermined rocking range, is restrained against rotation together with the second boss portion 26. Consequently, the upper and lower second massaging members 13 are moved close to and away from each other repeatedly in the vertical direction.

It is noted that there is a phase difference of 180° between the eccentric cam face of the second boss portion 26 for driving the upper member 31 and the eccentric cam face of the second boss portion 26 for driving the lower member 32 with respect to the axis of the rotation shaft 14. Thus, when the upper member 31 moves upward, the lower member 32 moves downward, and, when the upper member 31 moves downward, the lower member 32 moves upward.

Hence, the co-operative operation of the upper member 31 and the lower member 32 of the second massaging member 13 thus far described makes it possible to perform grabbing massage and pressing massage on a target body area located between the upper and lower members 31 and 32.

The massaging apparatus 1 pursuant to the present invention is characterized in that the second massaging member 13 pair is disposed between the paired first massaging members 12, and that the second conversion mechanism 16 is disposed between the paired first conversion mechanisms 15.

More specifically, along the axis of the rotation shaft 14, there are arranged, in left-to-right order, the first boss portion 24 provided in the first conversion mechanism 15 for driving the left-hand first massaging member 12 (the left-hand first boss portion 24); the second boss portion 26 of the second conversion mechanism 16 for driving the left-hand second massaging member 13 (the right-hand second boss portion 26 placed next to the right side of the first boss portion 24); and the first boss portion 24 provided in the first conversion mechanism 15 for driving the right-hand first massaging member 12 (the right-hand first boss portion 24 placed next to the right side of the second boss portion 26 of the second conversion mechanism 16 (the right-hand second boss portion 26)).

As described above, these first boss portions 24 are intended to impart horizontal rocking motion to the first massaging member 12, and, the second boss portion 26 is intended to impart vertical rocking motion to the second massaging member 13. The direction of mutually approaching and separating movements of the paired first massaging members 12 (horizontal direction) and the direction of mutually approaching and separating movements of the paired second massaging members 13 (vertical direction) are in intersecting relation to each other.

Such an arrangement of the first massaging member 12, the second massaging member 13, the first conversion mechanism 15, and the second conversion mechanism 16 makes it possible to dispose the boss portion of the first conversion mechanism 15 and the second boss portion 26 of the second conversion mechanism 16 adjacent each other on the rotation axis 14, and thereby achieve the proximity of the individual massaging mechanisms.

Thus, in the massaging apparatus 1 of this embodiment, the massaging mechanisms of different types arranged proximate to each other provide more elaborate massage for a target body area.

For example, the massaging apparatus 1 of this embodiment is capable of performing various types of massage treatment, such as kneading massage and grabbing massage, or kneading massage and pressing massage, on one and the same target body area (calf) with even higher massage effects.

The upper massaging system 6 of the massaging apparatus 1 of this embodiment has the earlier described vertically moving means 19 for allowing the first massaging member 12 and the second massaging member 13 to move in the vertical direction.

The vertically moving means 19 is designed to impart vertical movement to the first massaging member 12 and the second massaging member 13 by exploiting the earlier described rotational driving force of the rotation shaft 14 for driving the first and second massaging members 12 and 13. More specifically, the massaging apparatus 1 of this embodiment has the second rotation shaft 39 situated below the first rotation shaft 14 in parallel relation thereto. The rotational driving force of the rotation shaft 14 is transmitted, through the second rotation shaft 39, to the vertically moving means 19 for vertical movement of the massaging main body 2.

In the following description, the rotation shaft provided with the earlier described second gear 22 will be called "the first rotation shaft 14", and the rotation shaft disposed below the first rotation shaft 14 will be called "the second rotation shaft 39" to permit a positive distinction between them.

The described second rotation shaft 39 is a shaft member disposed below the first rotation shaft 14 so as to be directed in the horizontal direction in parallel with the first rotation shaft 14. An intermediate part of the second rotation shaft 39 in the direction of its length is provided with a third gear 40 which meshes with the described second gear 22, so that part of a rotational driving force exerted by the drive motor 23 can be transmitted also to the second rotation shaft 39. Thus, the third gear 40 allows the second rotation shaft 39 to rotate, just like the first rotation shaft 14, about a horizontally-directed axis.

The vertically moving means 19 of this embodiment is based on rack-and-pinion means, and thus comprises a pinion gear 41 disposed at each end of the described second rotation shaft 39 and a toothed rack 42 attached to the back frame member 9 (vertically-directed frame) of the massaging main body 2.

More specifically, the front surface of the vertically-directed back frame member 9 is formed with the vertically-extending toothed rack 42. The toothed rack 42 is made long enough to enable the movement of the described first and second massaging members 12 and 13 between knee and ankle regions.

Moreover, the vertically moving means 19 includes up-and-down bodies 20 mounted one at each end of the first rotation shaft 14 so as to be movable up and down unitarily with the first rotation shaft 14. The up-and-down bodies 20 have bearing portions located on the right side and the left side, respectively, of the described first rotation shaft 14 for rotatably supporting the first rotation shaft 14. The up-and-down bodies 20 are matingly fitted to the right side and the left side, respectively, of the described back frame member 9 for free movement in the direction in which the back frame member 9 is oriented (vertical direction). That is, in the described vertically moving means 19, by setting the pinion gear 41 of the second rotation shaft 39 in meshing engagement with the toothed rack 42 of the back frame member 9, it is possible to move the up-and-down body 20 in the vertical direction in which the back frame member 9 is directed, and thereby impart vertical movement to the first massaging member 12 and the second massaging member 13.

Figure 4:
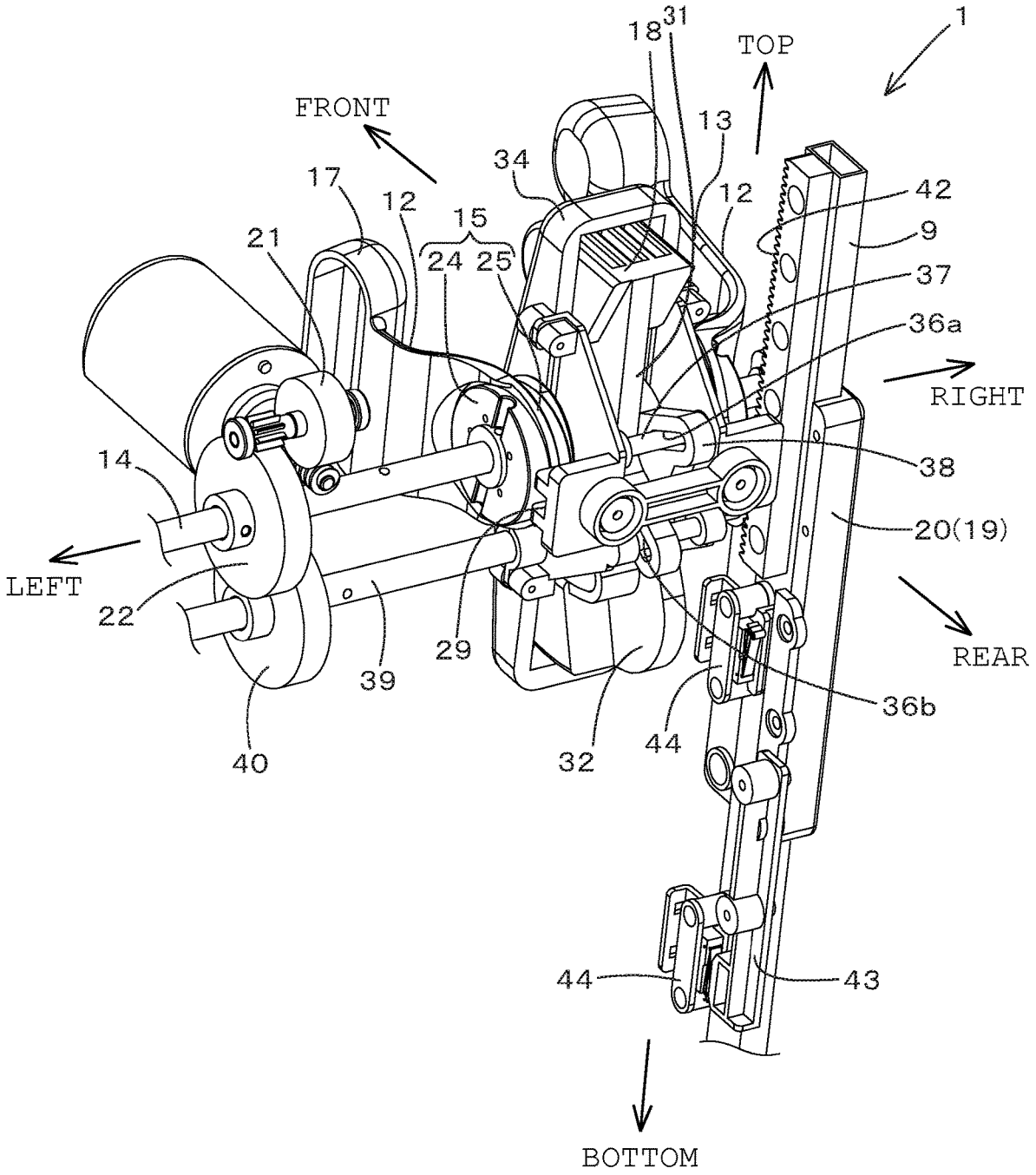
FIG. 4 is a rear perspective view showing vertically moving means provided in the upper massaging system of the present embodiment.
Figure 5:
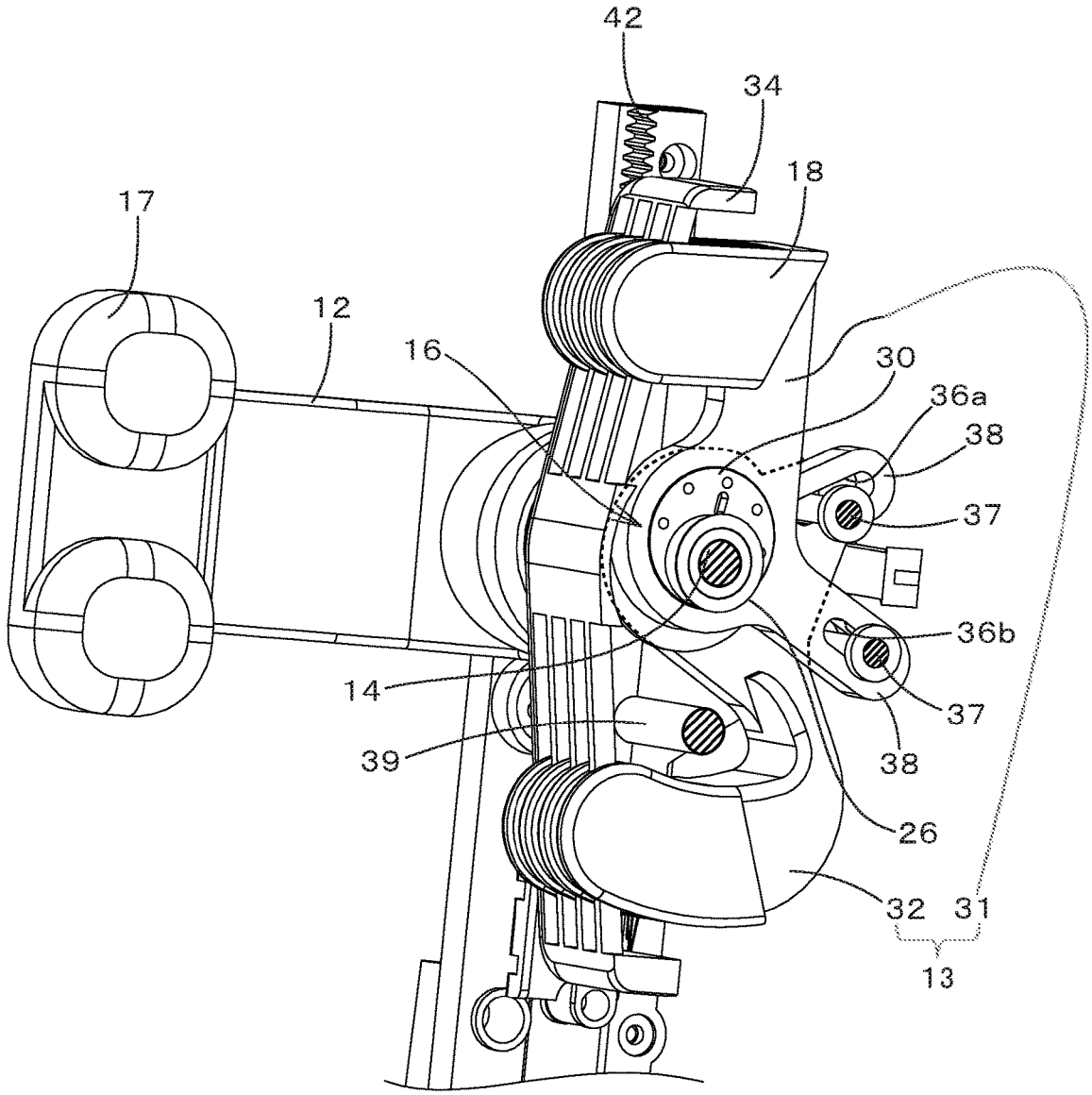
FIG. 5 is a sectional view of the upper massaging system of the present embodiment taken in a direction perpendicular to the axis of a rotation shaft.
Figure 6:
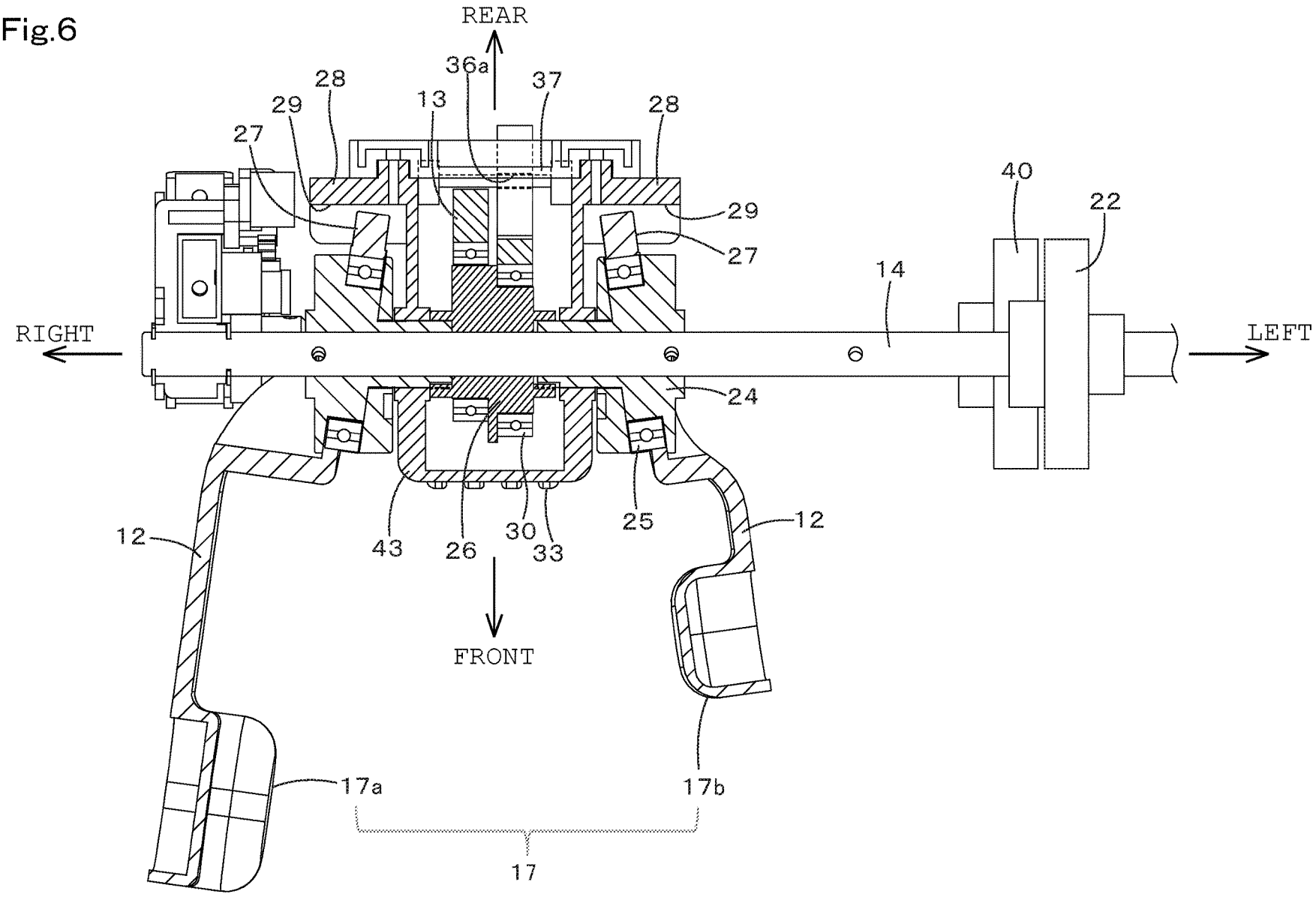
FIG. 6 is a sectional view of the upper massaging system of the present embodiment taken in a horizontal direction (a sectional view taken along the line B-B shown in FIG. 3).
Figure 7:
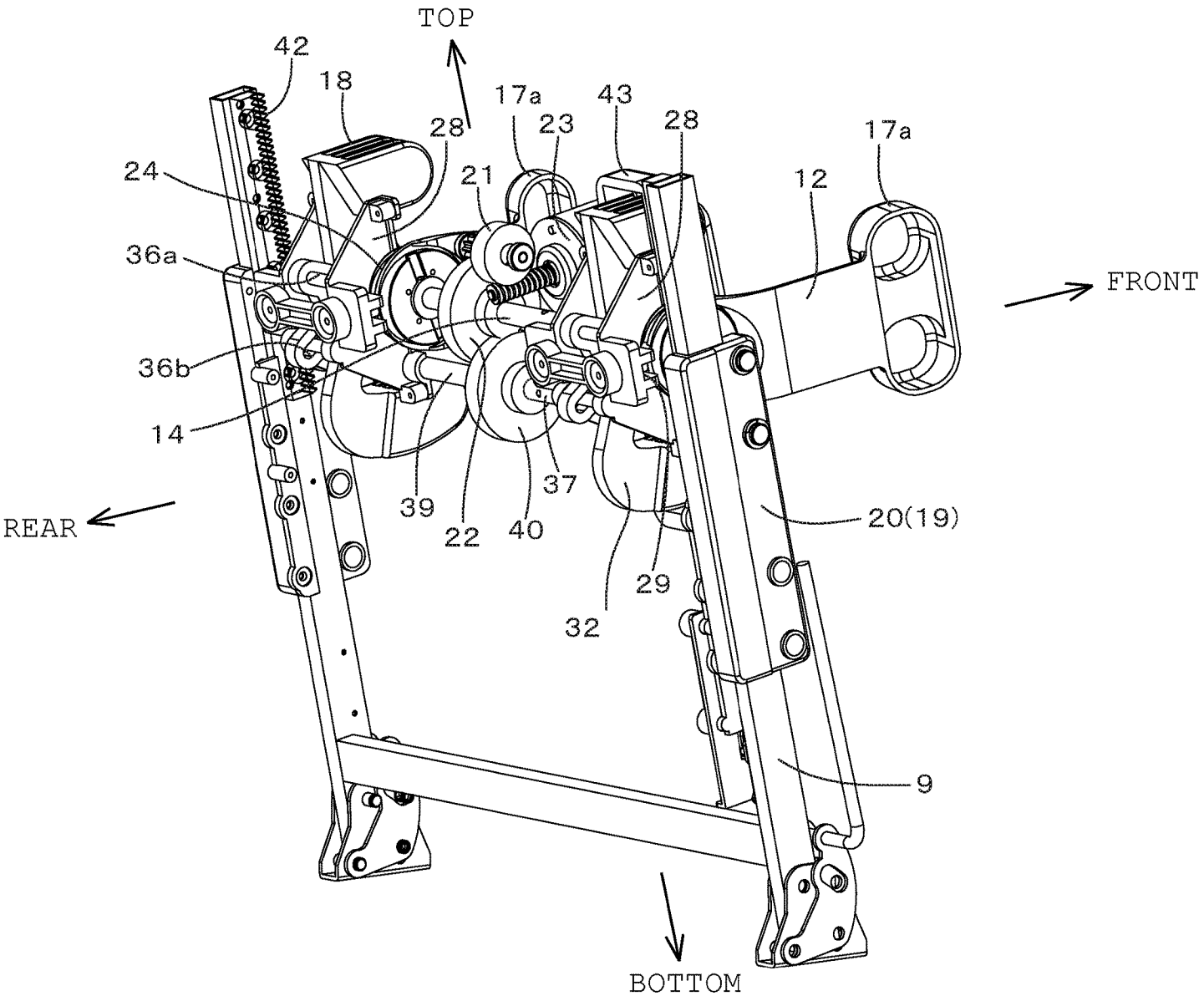
FIG. 7 is a perspective view of the upper massaging system of the present embodiment, as viewed from the back side.

As shown in FIG. 4, the described vertically moving means 19 has positioning means for effecting positioning of the up-and-down body 20 at two positions, namely the upper-limit position and the lower-limit position, within the range of vertical movement of the up-and-down body 20. The positioning means is composed of a positioning member 43 attached to the up-and-down body 20 and a positioning sensor 44 which is brought into contact with the positioning member 43 to detect the upper-limit position or the lower-limit position.

More specifically, the positioning member 43 is a member extending in protrusion form from the up-and-down body 20 in the direction in which the back frame member 9 is directed. The positioning member 43 has a positioning projection protruding toward the positioning sensor 44. Moreover, the positioning sensor 44 is a sensor attached to each of two locations of the back frame member 9, namely an upper part and a lower part. The positioning sensor 44 is capable of detecting a contact with the positioning projection of the positioning member 43.

That is, in the described vertically moving means 19, when the positioning projection of the positioning member 43 attached to the up-and-down body 20 is brought into contact with the positioning sensor 44 attached to the upper part of the back frame member 9, then it is determined that the first massaging member 12 and the second massaging member 13 assume the upper-limit position. On the other hand, when the positioning projection of the positioning member 43 attached to the up-and-down body 20 is brought into contact with the positioning sensor 44 attached to the lower part of the back frame member 9, then it is determined that the first massaging member 12 and the second massaging member 13 assume the lower-limit position.

The use of the thereby constructed vertically moving means 19 makes it possible to massage a target body area by moving the first massaging member 12 and the second massaging member 13 reciprocally in the vertical direction.

For example, when the positioning sensor 44 attached to the upper part of the back frame member 9 detects a contact with the positioning projection during the interval when the first massaging member 12 and the second massaging member 13 are moving upward, the direction of rotation of the drive motor 23 is reversed. Then, the direction of rotation of the pinion gear 41 of the second rotation shaft 39 is reversed, wherefore the first massaging member 12 and the second massaging member 13 are allowed to move upward.

Moreover, when the positioning sensor 44 attached to the lower part of the back frame member 9 detects a contact with the positioning projection during the interval when the first massaging member 12 and the second massaging member 13 are moving downward, the direction of rotation of the drive motor 23 is further reversed. Then, the direction of rotation of the pinion gear 41 of the second rotation shaft 39 is further reversed, wherefore the first massaging member 12, the second massaging member 13, and basic members are allowed to move upward once again.

In this way, efficacious massage treatment can be performed on a target body area over a wide range in the vertical direction by the co-operative operation of the first massaging member 12 and the second massaging member 13.

It should be understood that the embodiments as set forth hereinabove are considered in all respects as illustrative only and not restrictive. As to particulars that are not explicitly specified in the embodiments as disclosed hereinabove, for example, working conditions and operating conditions, and values on various parameters and the dimensions, weights, and volumes of constituent components are determined in the light of the common knowledge of those skilled in the art without departing from the normal range.

Figure 8:
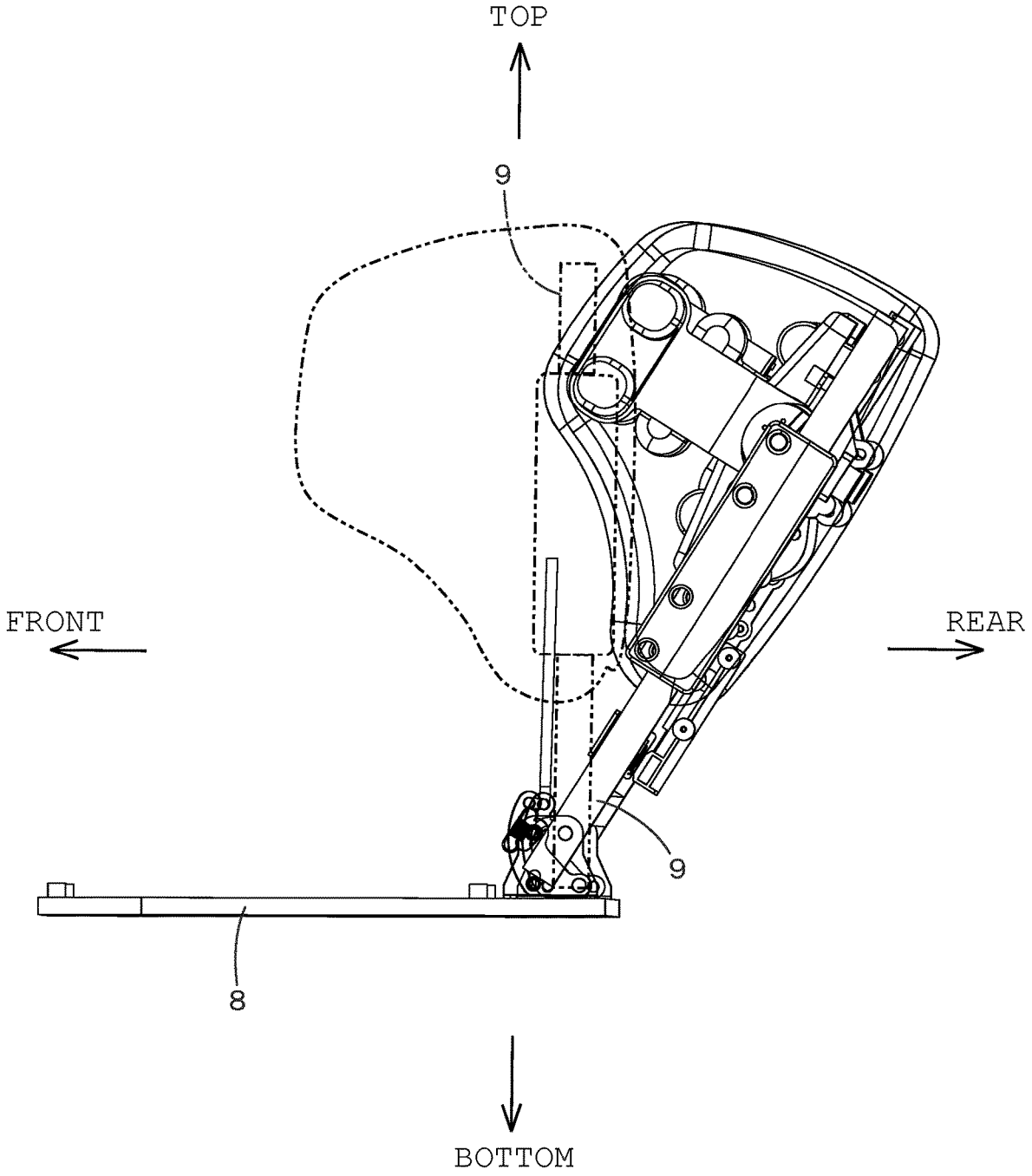
FIG. 8 is a view showing a rocking mechanism of the massaging apparatus of the present embodiment.

For example, when the user U tries to insert his/her legs into the insertion recesses 5 formed in the upper part of the massaging main body 2, if he/she has legs of greater-than-average size, the user may find it difficult to insert the legs into the insertion recesses 5. In such a case, as shown in FIG. 8, it is advisable that the lower end of the back frame member 9 is mounted for free rotation about a horizontally-directed axis relative to the stand frame member 8 so that the back frame member 9 can be tilted backward relative to the stand frame member 8 during insertion and withdrawal of user's legs. This makes it possible to insert the legs smoothly in the interior of the massaging apparatus 1, and thereby increase user's convenience in using the massaging apparatus 1.

Moreover, although the massaging apparatus 1 has been illustrated as a device for massaging the calf of user's leg as a target body area, the massaging apparatus 1 may be applicable to a device for massaging other body area than the calf, for example, the foot, the arm, or the wrist as a target body area.

EXPLANATION OF REFERENCE SYMBOLS

1 Massaging apparatus
2 Massaging main body
3 Support frame
4 Casing
5 Insertion recess
6 Upper massaging system
7 Lower massaging system
8 Stand frame member
9 Back frame member
10 Air massage member
11 Sole massage member
12 First massaging member
13 Second massaging member
14 Rotation shaft (First rotation shaft)
15 First conversion mechanism
16 Second conversion mechanism
17 First massager piece
18 Second massager piece
19 Vertically moving means
20 Up-and-down body
21 First gear
22 Second gear
23 Drive motor
24 First boss portion
25 First fit portion
26 Second boss portion
27 Restraint projection
29 Base member
29 Restraint slot
30 Second fit portion
31 Upper member of Second massaging member
32 Lower member of Second massaging member
33 Branch body
34 Cover body
35 Insertion hole
**36*a*** Restraint hole of Upper member
**36*b*** Restraint hole of Lower member
37 Restraint pin
38 Projection
39 Second rotation shaft
40 Third gear
41 Pinion gear
42 Toothed rack
43 Positioning member
44 Positioning sensor
U User

The invention claimed is:

1. A massaging apparatus comprising:

a pair of first massaging members for massaging a first target body area;

a pair of second massaging members, provided independently of said first massaging members, for massaging a second target body area;

a rotation shaft which is rotatably driven;

a first conversion mechanism and a second conversion mechanism, arranged as a pair, each disposed on corresponding one of said paired first massaging members, for converting a rotation of the rotation shaft into mutually approaching and separating movements of said paired first massaging members; and a third conversion mechanism for converting the rotation of said rotation shaft into mutually approaching and separating movements of said paired second massaging members, said pair of second massaging members being disposed between said pair of first massaging members, said third conversion mechanism being disposed between said paired first and second conversion mechanisms, wherein a tip of each second massaging member is branched into a plurality of branch bodies, wherein there is provided a cover body for covering the tip of each second massaging member, and wherein said cover body is formed with a plurality of insertion holes, through each of which is passed a corresponding one of the plurality of branch bodies of each second massaging member.

2. The massaging apparatus according to claim 1, wherein said pair of first massaging members are configured to perform a set of mutually approaching and separating movements and said pair of second massaging members are configured to perform another set of mutually approaching and separating movements and said set of mutually approaching and separating movements and said another set of mutually approaching and separating movements are in intersecting relation to each other.

3. The massaging apparatus according to claim 2, wherein said first conversion mechanism comprises:

a first boss portion, mounted for unitary rotation with said rotation shaft, having formed on its outer peripheral surface an inclined cam face inclined with respect to an axis of said rotation shaft; and a first fit portion disposed at a basal end of one of said pair of first massaging members and fitted exteriorly of the inclined cam face of the first boss portion so as to rotate, along with said one of the pair of first massaging members, along the inclined cam face of said first boss portion in response to the rotation of the rotation shaft, wherein said second conversion mechanism comprises:

a second boss portion, mounted for unitary rotation with said rotation shaft, having formed on its outer peripheral surface an inclined cam face inclined with respect to the axis of said rotation shaft; and a second fit portion disposed at a basal end of the other of the pair of first massaging members and fitted exteriorly of the inclined cam face of the second boss portion so as to rotate, along with said the other of the pair of first massaging members, along the inclined cam face of said second boss portion in response to the rotation of the rotation shaft, and wherein each first massaging member is restrained against rotation together with said rotation shaft.

4. The massaging apparatus according to claim 3, wherein said third conversion mechanism comprises:

a third boss portion which has formed on its outer peripheral surface an eccentric cam face which moves around an axis in eccentric relation to the axis of said rotation shaft; and a third fit portion disposed at a basal end of said pair of second massaging members and fitted onto the eccentric cam face of the third boss portion so as to rotatably engage the eccentric cam face of said third boss portion and rotate along with eccentric cam face in an eccentric path around the axis of the rotation shaft in response to the rotation of the rotation shaft, and wherein each second massaging member is restrained against rotation together with said rotation shaft.

5. The massaging apparatus according to claim 4, wherein, the first boss portion, the second boss portion, and the third boss portion are arranged along the axis of said rotation shaft, the third boss portion being positioned between the first boss portion and the second boss portion.

6. The massaging apparatus according to claim 1, further comprising:

vertically moving means for allowing said pair of first massaging members and said pair of second massaging members to move in a vertical direction.

7. The massaging apparatus according to claim 6, wherein said vertically moving means imparts vertical movement to said pair of first massaging members and said pair of second massaging members by exploiting a rotational driving force of another rotation shaft disposed in parallel with said rotation shaft.

* * * * *